United States Patent [19]

Eggermann

[11] 4,232,823

[45] Nov. 11, 1980

[54] METHOD AND APPARATUS FOR INSTALLATION OF QUENCH CAR TRACK FOR COKE OVEN BATTERIES

[75] Inventor: Paul P. Eggermann, Milltown, N.J.

[73] Assignee: Inseco Associates, Inc., East Brunswick, N.J.

[21] Appl. No.: 36,572

[22] Filed: May 7, 1979

[51] Int. Cl.[3] ..... E01B 1/00

[52] U.S. Cl. ..... 238/7; 238/2; 404/27; 404/43; 404/82; 405/38

[58] Field of Search ..... 238/1, 2, 5–9; 104/1 R, 2, 3, 11; 404/18, 27–29, 31, 43, 82; 405/16, 17, 38, 229; 52/169.9, 169.14

[56] References Cited

U.S. PATENT DOCUMENTS

| | | | |
|---|---|---|---|
| 1,702,841 | 2/1929 | Rüping | 238/2 |
| 2,420,833 | 5/1947 | Monroe | 238/2 |
| 3,878,987 | 4/1975 | Uzuka | 238/2 |

FOREIGN PATENT DOCUMENTS

| | | | |
|---|---|---|---|
| 557163 | 8/1932 | Fed. Rep. of Germany | 238/2 |
| 2511685 | 9/1975 | Fed. Rep. of Germany | 238/8 |
| 7703279 | 9/1978 | Netherlands | 238/7 |
| 146471 | 7/1931 | Sweden | 404/43 |
| 788710 | 1/1958 | United Kingdom | 404/29 |

*Primary Examiner*—Randolph A. Reese
*Attorney, Agent, or Firm*—Arthur L. Lessler

[57] ABSTRACT

A technique for rapid installation of corrosion resistant quench car railroad track wherein levelling blocks are embedded in a slag base, a layer of polyethylene is laid over the base and levelling blocks, and a thin layer of gravel is disposed on the polyethylene sheet. Mating precast concrete panels are placed end to end for supporting the ties and rails, with the adjacent edges of the panels overlying the levelling blocks. Ties and rails are installed on the upper surfaces of the panels, and drainage ramp and channel structures are provided on opposite sides of the panels. The panels have vertical holes therein through which an epoxy resin is injected into the underlying gravel layer, the epoxy being horizontally directed by the plastic sheet. The epoxy subsequently hardens, bonding the gravel particles together and forming a stable underlayment for the concrete panels.

18 Claims, 4 Drawing Figures

METHOD AND APPARATUS FOR INSTALLATION OF QUENCH CAR TRACK FOR COKE OVEN BATTERIES

This application relates to a method and apparatus for installation of railroad track, and is particularly suitable for (but not limited to) the installation of quench car track for coke oven batteries.

In the manufacture of coke, coal is heated in a substantially oxygen—deprived atmosphere to form the coke. The heating is done in relatively large coke oven batteries which must be operated on a substantially continuous basis, since shutdown of a battery for a period of more than 24 hours may result in permanent and substantial damage to the battery, with consequent repair costs running in the millions of dollars.

As each batch of coke is made, it is ejected from the corresponding oven at a relatively high temperature on the order of 2,400° F., and dumped into a quench car, which rides along a railroad track adjacent to the coke battery, said track being commonly referred to as the quench car track.

Each such very hot batch of coke is then moved by the quench car to a quenching station, at which several tons of water are dumped on the batch, and consequently on the quench car and the underlying track, to cool off or quench the coke.

The quenching water partially drains from the track, and partially soaks the track. This water picks up sulphur compounds and other waste products from the coke, and becomes highly acidic, with a typical pH on the order of 6 or less.

Due to the various cyanide, arsenic and sulphur compounds released during the coke making process, the atmosphere surrounding the quench car railroad track is also highly corrosive.

The resulting corrosive atmosphere and corrosive water which soaks the quench car track causes rapid deterioration of the track ties and ballast bed, as a result of which they must be repaired or replaced at approximately six month intervals. Such replacement of the approximately 300 feet of quench car track for each battery on a semi-annual basis is quite expensive, with additional expense being incurred as a result of the lost coke oven production capacity and possible shortened oven life during the shutdown periods for replacement of the track.

Accordingly, an object of the present invention is to provide an improved method and apparatus for installation of quench car track, providing a more durable and corrosion resistant track construction, and capable of installation of 300 feet of track within a period of less than 24 hours.

As herein described there is provided a method for installing railroad track on a base, comprising the steps of: embedding at least one levelling block in said base; placing a layer of nonpermeable flexible sheet material on said base and levelling block; depositing a layer of aggregate on said sheet material; placing at least two elongated precast concrete panels on said aggregate layer with adjoining portions thereof overlying said levelling block, each of said panels having a plurality of vertically oriented holes therethrough; installing ties and rails on said precast concrete panels; and injecting a viscous hardenable grout into said layer of aggregate.

Also herein described is a quench car track installation for a coke oven battery, comprising: a slag base; at least two parallel elongated levelling blocks embedded in said base; a layer of nonpermeable sheet material on said base and levelling blocks; a layer of aggregate on said sheet material overlying said levelling blocks; a bonding agent distributed through said aggregate layer for bonding the particles thereof together; at least two elongated precast concrete panels disposed on said aggregate layer with adjoining portions thereof overlying said levelling blocks; a plurality of ties secured to the upper surfaces of said panels; and a pair of rails mounted on said ties.

IN THE DRAWING

Quench car track is normally installed on a base of slag or ballast, and this practice is followed in the technique herein described. The existing slag supporting the deteriorated quench car track which is to be replaced, is removed along with the old track.

Figure 1:
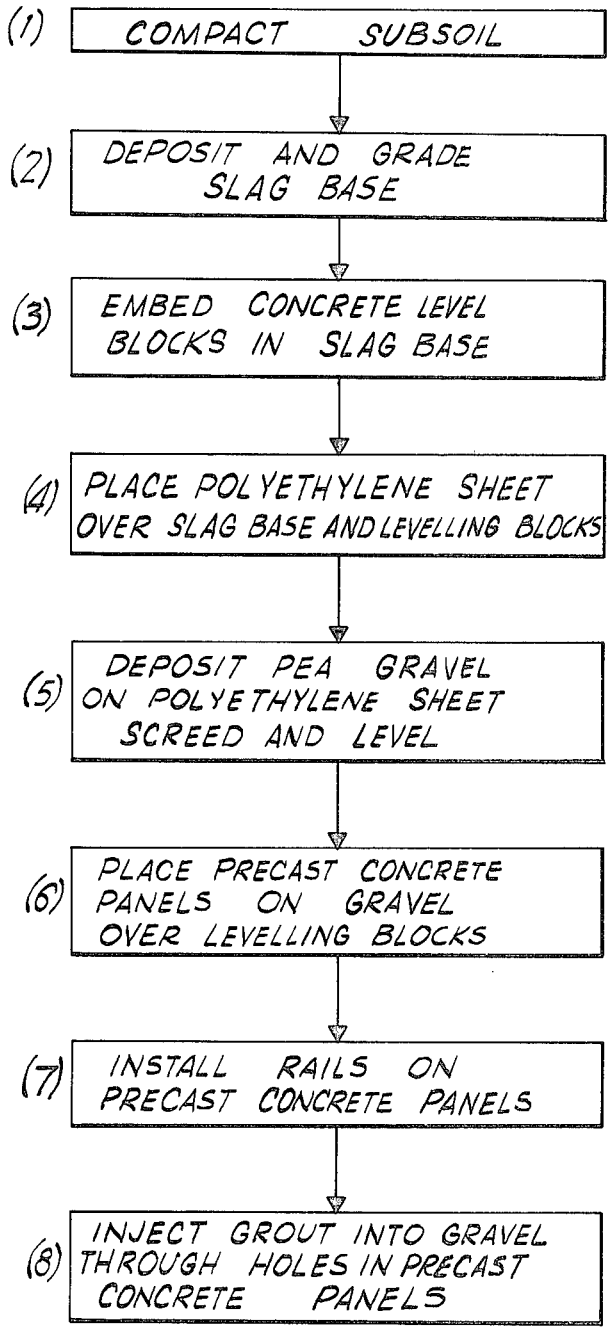
FIG. 1 is a flow diagram illustrating the major steps of a quench car track installation method according to a preferred embodiment of the invention.

As shown in step 1 of FIG. 1, the underlying subsoil or ballast is then compacted, by rolling, and a fresh slag base is deposited and graded to a roughly flat cross section.

Figure 4:
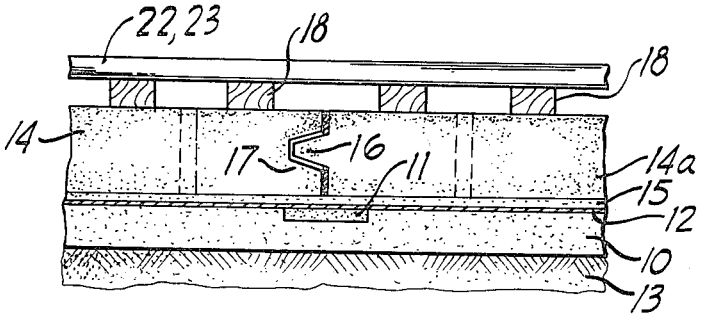
FIG. 4 is a cross sectional view of a portion of the quench car track illustrated in FIG. 3.

The resulting graded slag base is denoted by the numeral 10 in FIG. 4.

As indicated at step 3, concrete levelling blocks 11 are then embedded in the slag base, to insure proper alignment of adjacent track sections to be subsequently installed. Each of the blocks 11 comprises reinforced concrete and has the shape of an elongated rectangular prism, with typical dimensions of 6 in.×24 in.×10 ft. long. Preferably the levelling blocks 11 are embedded oriented with their longitudinal axes transverse or perpendicular to the track to be installed. The upper surfaces of the levelling blocks 11 should be disposed a predetermined distance above the graded slag surface, to allow for downward deflection of the levelling blocks in response to the weight of the subsequently installed precast panels (prior to hardening of underlying grout as hereafter described). Typically, a projection of the levelling blocks 11 above the slag surface of less than 1" provides good results. The exact amount of projection is preferably determined empirically or by a thorough soils analysis.

The levelling blocks 11 are of course embedded in the slag base 10 so that their upper surfaces are horizontal and coplanar.

As indicated by step 4, a polyethylene sheet 12 is then placed over the slag base 10 and levelling blocks 11 (which in turn are supported by the compacted subsoil 13).

The polyethylene sheet 12 is preferably a flexible material having a thickness on the order of 10 mils, and need not comprise a single unitary sheet. Sections of the sheet material 12 can be overlapped as necessary to cover the desired surface area of the slag base 10 and levelling blocks 11. While polyethylene is preferred due to its relatively low cost and desirable handling qualities, other nonpermeable flexible sheet materials such as plastics, metal foil or coated heavy-duty paper may alternatively be employed.

In order to assure proper operation of the quench car, the quench car track must be extremely flat, i.e. horizontal, and must maintain such flatness over an extended period of time. If the track is not flat, the quench car cannot be positioned and moved without upsetting predetermined critical tolerances between track-mounted equipment and coke oven battery-mounted equipment.

To provide a highly stable support for the track and a conforming underlayment for the precast panels 14 and 14*a* to be subsequently installed, a relatively thin layer 15 of pea gravel is deposited on the polyethylene sheet 12. Although pea gravel is preferred, other aggregate materials may alternatively be employed.

The pea gravel layer 15 is deposited to a thickness of approximately 1 in., and subsequently screeded and levelled. The resulting layer may have a thickness varying from ½ in. to 1½ in., but said thickness is not critical.

Adjacent ends of the elongated precast concrete panels 14 and 14*a* are then placed adjacent to each other, so that the tongue 16 of the panel 14*a* engages the groove 17 of the panel 14, and the adjacent edges of said panels overlie the levelling blocks 11.

The aforementioned gravel deposition and precast concrete panel placement steps are designated by steps 5 and 6 in FIG. 1.

The next step in the quench car track installation process is the installation of the ties 18, spaced apart from each other by suitable intervals and oriented transverse to the longitudinal axes of the panels 14 and 14*a*. Preferably, the panels 14 and 14*a* are 19.5 ft. long, the ties are spaced center to center by approximately 1.75 feet, and support standard 39 ft. long rail sections.

Figure 3:
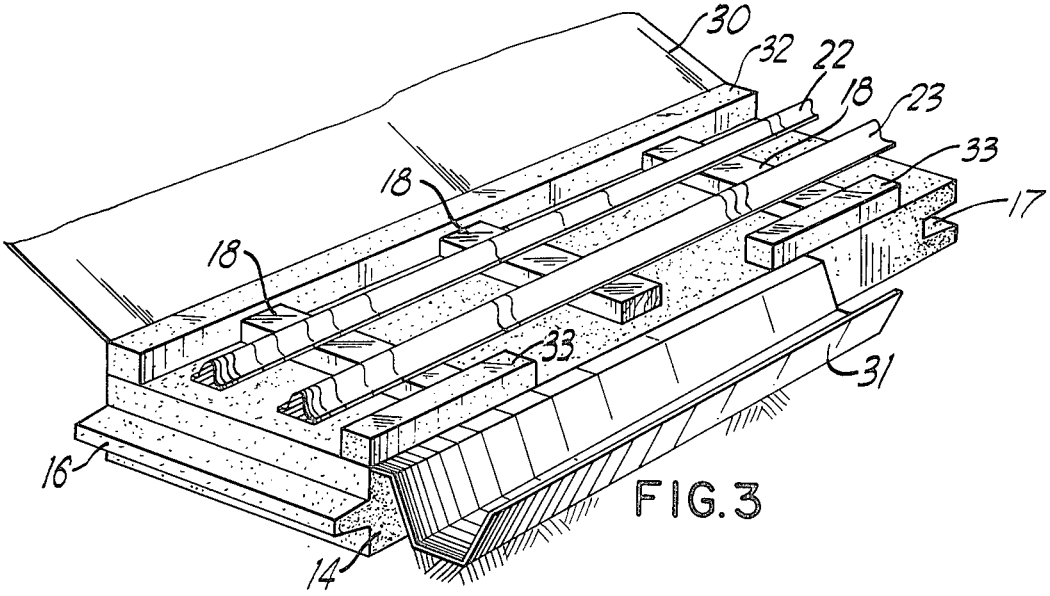
FIG. 3 is a perspective view of a section of completed quench car track in accordance with the present invention.

As best seen in FIGS. 3 and 4, each of the ties 18 comprises a wood block 21. The ties 18 may be secured to the upper surfaces of the precast concrete panels 14 and 14*a* by any suitable means, such as expansion bolts, rods having one end embedded in the panels, or the like. The ties 18 are restrained against lateral or longitudinal movement by raised concrete bosses on the panels 14 and 14*a*.

After the ties 18 are installed, a pair of rails 22 and 23 is disposed on and secured to the upper surfaces of the ties 18, the rails being oriented in parallel straight lines by means of a transit or other suitable instrument. Alternatively, a preassembled array of rails and ties (with appropriate fittings) may be installed as a unit on the panels 14 and 14*a*.

Figure 2:
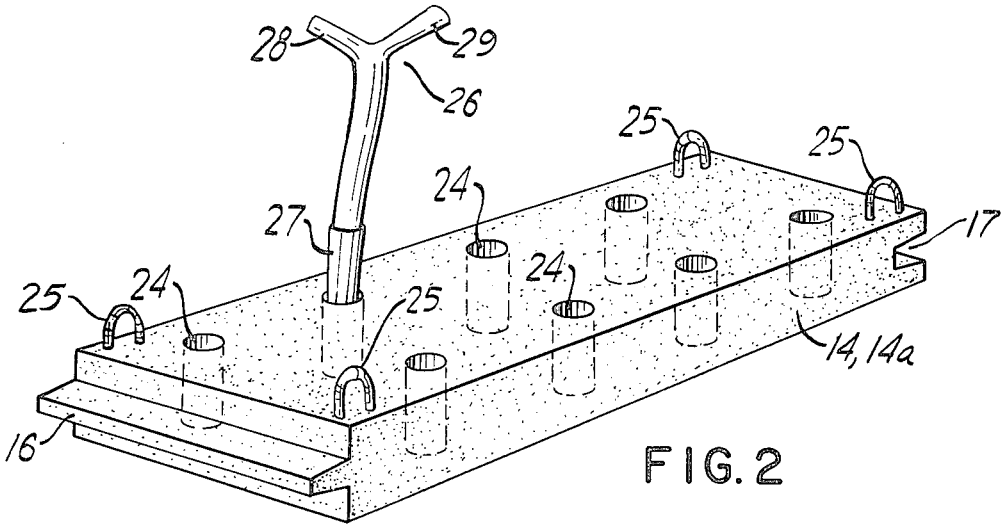
FIG. 2 is a perspective view of a precast concrete panel for use in carrying out the method illustrated in FIG. 1.

As shown most clearly in FIG. 2, each of the precast concrete panels 14 and 14*a* has eight vertically oriented holes 24 extending through each panel between the upper and lower major surfaces thereof. Each of the holes 24 may typically have the diameter on the order of 2 in. with a distance on the order of 5 ft. between adjacent holes. These dimensions, however, are not critical.

Each of the panels 14 and 14*a* is also equipped with four lifting lugs 25.

After the ties 18 and rails 22, 23 are installed, a suitable viscous grout is injected into the gravel layer 15 through the holes 24 in the panels 14 and 14*a*.

The grout preferably comprises an epoxy resin having a resin component and a hardener component, with said components contained in relatively large drums (typically 55 gallons each) mounted on a suitable conveyor which rides along the rails 22, 23, enabling the grout to be rapidly applied to successive ones of the holes 24.

The resin and hardener liquids are preferably injected into each of the holes 24 by means of an injection head 26 having a frustoconical nozzle 27 for engaging each of the holes 24. Resin is delivered to the head 26 via a conduit 28, and hardener is delivered thereto via a conduit 29, with said resin and hardener components being mixed in the head 26 just prior to injecton into the holes 24. Preferably the mixed resin and hardener components are injected into the holes 24 at a pressure on the order of 10 psi. Alternatively, injection pressures in the range of 5 to 15 psi may be utilized.

As the epoxy resin viscous liquid is injected into the holes 24, it is guided by the bottom surfaces of the panels 14 and 14*a* and the upper surface of the polyethylene sheet 12, to flow horizontally through the gravel layer 15, thus permeating said layer and, upon subsequent hardening of the epoxy material, bonding the particles of the layer 15 together to form a stable underlayment for the panels 14 and 14*a* and ties 18 and rails 22, 23 mounted thereon.

Preferably a high strength, low viscosity, moisture—insensitive two—component (100% solids) epoxy resin such as Sikadur Hi-Mod LV, manufactured and sold by Sika Chemical, Lyndhurst, New Jersey, is employed, having an exothermic curing characteristic with a cure time of approximately 3 to 4 hours at 68° F. to 73° F. Alternatively, other self-curing bonding agents may be employed, it being preferable, however, that exposure to the atmosphere not be required by the curing process.

In order to minimize interference with the curing process and possible weakening of the bonding effect, the gravel 15 should preferably be dry, although this is not an essential requirement. Dried pea gravel yields satisfactory results. The gravel size should preferably range from ⅛ in. to ⅜ in., with an average on the order if ¼ in.

After the epoxy resin has cured, filling the holes 24 and stabilizing the gravel layer 15, the completed quench car track is ready for use.

Preferably, concrete structures are cast on opposite sides of the track, i.e. of the precast concrete panels 14 and 14*a*, to form an upwardly sloping ramp 30 on one side and a drain channel 31 on the opposite side, as shown in FIG. 3. These structures facilitate drainage of water from the track, thus reducing the effects of saturation and corrosion of the ties and rails.

Elongated concrete elements 32 and 33 are provided along opposite sides of the panels 14 and 14*a* to restrain lateral movement of the ties 18, with the element 33 having open areas to permit drainage of water into the channel 31.

To provide additional lengths of track, the aforementioned process is carried out utilizing additional precast panels similar to 14 and 14*a*, with additional ties 18 and rails 22, 23 mounted thereon.

Utilizing the installation method described above, 300 ft. of quench car track can be installed and returned to service within a 24 hour period, thus minimizing coke oven production loss and insuring that there will be no damage to the coke oven batteries served by the track.

The resulting track has permanently aligned ties and rails, concrete levelling blocks and precast panels, and thus exhibits superior corrosion resistance and a useful life several times greater than that of quench car tracks presently in use on conventional ballast, and insures reliable operation of the equipment to be placed in service on the track.

I claim:

1. A method for installation of railroad track on a subsoil, comprising the steps of:

compacting the subsoil;

depositing a slag base on the subsoil and subsequently grading the base;

embedding at least two parallel elongated levelling blocks in said base, with said blocks protruding a predetermined distance therefrom and the upper surfaces of said blocks substantially coplanar;

placing a layer of nonpermeable flexible sheet material on said base and levelling blocks;

depositing a layer of aggregate on said sheet material;

placing at least two elongated precast concrete panels on said aggregate layer overlying said levelling blocks, each of said panels having a plurality of vertically oriented holes therethrough;

installing ties and rails on said precast concrete panels; and injecting a viscous hardenable grout into said aggregate layer through said holes, and allowing said grout to harden.

2. The method according to claim 1, comprising the additional step of screening and levelling said gravel layer before placing said precast concrete panels thereon.

3. The method according to claim 1, wherein said gravel layer comprises pea gravel and is deposited to a thickness on the order of one inch.

4. The method according to claim 1, wherein said gravel is dried prior to deposition thereof.

5. The method according to claim 1, wherein said grout comprises an epoxy resin.

6. The method according to claim 5, wherein said grout comprises a resin component and a hardener component contained in respective drums, and said injecting step includes transporting said drums to the injection site by means of said rails.

7. The method according to claim 1, wherein said levelling blocks are disposed below adjoining portions of adjacent ones of said precast concrete panels.

8. The method according to claim 1, wherein said grout is injected at a pressure on the order of 5 to 15 p.s.i.

9. A method for installing railroad track on a base, comprising the steps of:

embedding at least one levelling block in said base;

placing a layer of nonpermeable flexible sheet material on said base and levelling block;

depositing a layer of aggregate on said sheet material;

placing at least two elongated precast concrete panels on said aggregate layer with adjoining portions thereof overlying said levelling block, each of said panels having a plurality of vertically oriented holes therethrough;

installing ties and rails on said precast concrete panels; and injecting a hardenable grout into said gravel layer.

10. The method according to claim 9, comprising the additional steps of compacting the subsoil on which the track is to be laid, and depositing and grading a slag base thereon prior to said embedding step.

11. The method according to claim 9, wherein said aggregate layer comprises dried pea gravel and is deposited to a thickness of approximately one inch.

12. The method according to claim 9, wherein each levelling block is elongated in the transverse direction of said panels, said blocks being embedded with the upper surfaces thereof substantially coplanar.

13. The method according to claim 12, wherein said blocks are embedded so that the upper surfaces thereof protrude a predetermined distance above said base.

14. The method according to claim 9, wherein said grout is injected at a pressure on the order of 5 to 15 p.s.i.

15. A quench car track installation for a coke oven battery, comprising:

a slag base;

at least two parallel elongated levelling blocks embedded in said base;

a layer of nonpermeable sheet material on said base and levelling blocks;

a layer of aggregate on said sheet material overlying said levelling blocks;

a bonding agent distributed through said aggregate layer for bonding the particles thereof together;

at least two elongated precast concrete panels disposed on said aggregate layer with adjoining portions thereof overlying said levelling blocks;

a plurality of ties restrained against movement in a horizontal plane with respect to the upper surfaces of said panels; and a pair of rails mounted on said ties.

16. The installation according to claim 15, wherein said adjoining portions of said precast concrete panels form a tongue-and-groove joint.

17. The installation according to claim 15, wherein each of said panels has an upwardly sloping ramp adjacent one lateral side thereof and a longitudinal drainage channel adjacent the opposite lateral side thereof.

18. The installation according to claim 15, further comprising a plurality of lifting lugs secured to the upper surface of each of said panels.

* * * * *